United States Patent [19]

Kaae

[11] Patent Number: 4,597,936

[45] Date of Patent: Jul. 1, 1986

[54] LITHIUM-CONTAINING NEUTRON TARGET PARTICLE

[75] Inventor: James L. Kaae, Solana Beach, Calif.

[73] Assignee: GA Technologies Inc., San Diego, Calif.

[21] Appl. No.: 541,126

[22] Filed: Oct. 12, 1983

[51] Int. Cl.[4] ..... G21C 3/00

[52] U.S. Cl. ..... 376/411; 376/172; 376/173; 376/414; 423/600

[58] Field of Search ..... 423/600; 376/411, 414, 376/172, 173

[56] References Cited

U.S. PATENT DOCUMENTS

| | | | |
|---|---|---|---|
| 3,089,785 | 5/1963 | Lewis et al. | 117/71 |
| 3,122,595 | 2/1964 | Oxley | 264/21 |
| 3,151,037 | 9/1964 | Johnson et al. | 176/67 |
| 3,276,968 | 10/1966 | Ingleby | 176/69 |
| 3,301,763 | 1/1967 | Beatty et al. | 176/67 |
| 3,312,597 | 4/1967 | Glueckauf | 176/67 |
| 3,554,783 | 1/1971 | Beutler et al. | 117/46 |
| 3,649,452 | 3/1971 | Chin et al. | 176/68 |
| 3,650,896 | 3/1972 | Goeddel | 176/68 |
| 3,669,832 | 6/1972 | Boettcher | 176/68 |
| 3,736,169 | 5/1973 | Graham et al. | 117/46 |
| 3,798,123 | 3/1974 | Lindemer | 176/67 |
| 3,804,664 | 4/1974 | Ikawa et al. | 117/106 |
| 3,846,154 | 11/1974 | Lefevre | 117/46 |
| 3,878,041 | 4/1975 | Leitnaker et al. | 176/67 |
| 3,907,948 | 9/1975 | Gyarmati et al. | 264/0.5 |
| 3,992,258 | 11/1976 | Tobin | 176/67 |
| 4,077,838 | 3/1978 | Lindemer et al. | 176/68 |
| 4,267,019 | 5/1981 | Kaae et al. | 176/82 |
| 4,405,595 | 9/1983 | Yang | 423/600 |

*Primary Examiner*—Donald P. Walsh

*Attorney, Agent, or Firm*—Fitch, Even, Tabin & Flannery

[57] ABSTRACT

To provide a lithium-containing neutron target particle for breeding tritium within the core of a nuclear reactor, including a central core formed of a stable lithium-containing compound, a surrounding buffer layer, and an outer tritium-impermeable silicon carbide coating, the core is initially sealed with an inner sealing layer of pyrolytic carbon and an outer sealing layer of stoichiometric zirconium carbide. The pyrocarbon seal protects the lithium within the core from attack from the zirconium carbide coating atmosphere, and the zirconium carbide layer prevents loss of lithium from the core when the silicon carbide coating is deposited at elevated temperatures.

20 Claims, 1 Drawing Figure

LITHIUM-CONTAINING NEUTRON TARGET PARTICLE

The present invention is directed to tritium breeding material and more particularly to lithium-containing particles having an outer coating which retains bred tritium.

BACKGROUND OF THE INVENTION

For potential use in nuclear fusion reactors and for use in weapons systems, there is a need for convenient sources of relatively concentrated tritium. Tritium, which is a very minor isotopic component of hydrogen, is separable from lighter isotopes, but only by very tedious, expensive methods. An alternative to tritium isolation is tritium breeding in which other elements are transmutated to tritium through neutron capture. For example, tritium is produced by thermal neutron capture by $^6Li$ which decays to tritium and helium. Nuclear reactors produce an excess of stray neutrons which might potentially be used in breeding tritium through neutron capture transmutation reactions. If a lithium-containing compound is disposed in the core of a nuclear reactor, tritium will be produced.

Particularly suitable lithium-containing compounds for tritium breeding are the lithium aluminum oxides, $LiA1O_2$ and $LiAl_5O_8$, which have high atom percents of lithium and have high melting points (respectively about 1610° C. and 1900° C.). Lithium aluminum oxide may be provided in the form of minute spherical particles as is taught in U.S. patent application, Ser. No. 339,697, filed Jan. 15, 1982, the teachings of which are incorporated herein by reference.

Tritium is a highly radioactive isotope and it presents particular difficulties in handling and containment because, like the other hydrogen isotopes, it has a tendency to diffuse through many materials. If a nuclear reactor is used to breed tritium, it is important to contain the bred tritium so that it does not contaminate the coolant gas or escape from the reactor environment. Thus, in a nuclear reactor, it is necessary to encase the breeding material in tritium-impermeable material. As one method of retaining tritium, particulate material, such as lithium aluminum oxide, may be coated with a tritium-impermeable shell. It has been proposed to coat lithium aluminum oxide particles with a TRISO type coating similar to that used for nuclear fuel particle coatings. This coating type consists of a layer of porous carbon, a layer of an isotropic dense carbon, a layer of silicon carbide and a layer of an isotropic dense carbon. For tritium breeding particles, the two most important layers are the porous carbon, the porosity of which supplies volume for accomodating the gaseous tritium and helium, and the silicon carbide, which is a barrier for the diffusive release of the tritium. However, difficulties have arisen when attempting to form such coated lithium aluminum oxide particles.

There are no problems in depositing the porous carbon layer at a temperature of about 1100° C. or the isotropic dense carbon layer at a temperature of about 1300° C. However, problems develop when depositing the silicon carbide layer at a temperature of about 1550° C. At this temperature, lithium begins to be lost from the particle. Simultaneously, the inner dense carbon coating and the buffer coating often crack, and in extreme cases totally disintegrate, presumably due to the formulation of intercalation compounds between the lithium and the carbon. Thus, in the least damaging case, the particles contain little lithium after coating, and in the most damaging case, the particles break up during coating.

In order to effectively use coated lithium aluminum oxide particles for tritium breeding, it is necessary to develop a method of preventing lithium loss from the particles during silicon carbide coating.

It would be desirable to effectively coat lithium aluminum oxide with SiC in a manner that does not result in lithium loss therefrom.

SUMMARY OF THE INVENTION

Tritium breeding is provided in the form of lithium-containing particles having a TRISO-type coating which retain tritium bred by transmutation of lithium. A core is coated with a seal layer of dense, isotropic carbon and then coated with a seal layer of ZrC having approximately a 1:1 atom ratio of Zr and C. The ZrC layer withstands the high temperature of SiC deposition and prevents lithium loss during SiC deposition.

BRIEF DESCRIPTION OF THE DRAWING

The FIGURE is a cross-sectional view of a particle embodying various features of the present invention.

DETAILED DESCRIPTION OF A PREFERRED EMBODIMENT

Figure 1:
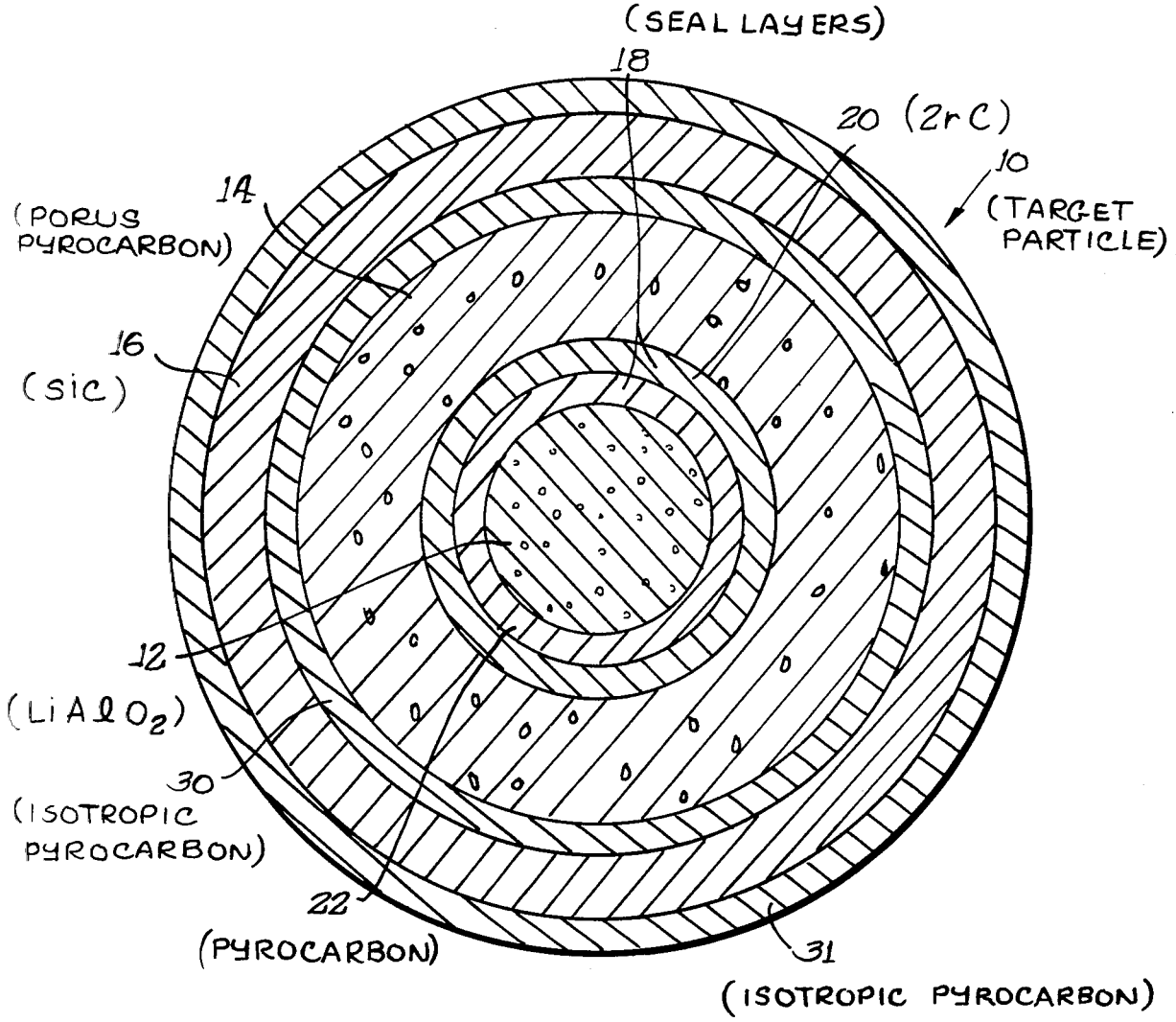

Lithium-containing particles 10 are provided that are useful for producing tritium in reactors having high excess neutron flux, such as a high temperature gas cooled reactor (HTGR). The target particles are neutronically compatible with the nuclear fission reaction and can be disposed within the core in the place of burnable poison, such as boron, that would normally be included in the fuel elements and also in the place of some or most of the thorium that is conventionally used to breed fissionable material. Reducing the amount of fertile material, of course, raises the fuel cost of the reactor because the fairly large amounts of U-233 bred from fertile thorium is reduced; however, the value of the bred tritium indicates that tritium breeding is economically attractive.

The lithium in the particle 10 is located in a generally spherical core 12, formed of a lithium-containing compound that is stable at the coating temperatures of outer coating layers and at the operational temperature of the nuclear reactor. Surrounding the core is a buffer layer 14 of porous pyrolytically-deposited material having interstices in which the bred tritium and helium can accumulate. This buffer layer prevents excessive pressure build-up within the particle 10 as gaseous tritium and helium is bred. An outer coating 16 surrounding the buffer layer 14 is formed of a material that is impermeable to tritium at the operational temperature of the reactor and therefore retains the bred tritium until the particles are removed from the reactor core and the tritium is recovered from the particles. The preferred material for the retention of lithium is silicon carbide (SiC), a layer 16 of which makes up one component of the outer coating.

In accordance with the invention, a two-layer seal 18 is deposited around the core 12 before the buffer layer 14 is deposited. The outer seal layer 20 is zirconium carbide having a specific stoichiometric ratio of Zr to C which is found to prevent lithium diffusion from the core and loss of lithium from the particle when subsequent coating layers are deposited. The inner seal layer 22 prevents reaction of the core material with the coating atmosphere during the ZrC seal layer deposition.

Providing the lithium-containing material in tiny particles 10 allows the lithium-containing material to be distributed within a nuclear reactor so as to maximize the capture of neutrons for tritium breeding. $^6Li$ has an extremely large cross section, equal to about 953 barns, for the absorption of neutrons in the thermal energy range and the consequent transmutation to produce tritium and helium. As a result, lithium is inherently self-shielding, and in order to induce efficient conversion of $^6Li$ to tritium, it is important to disperse the lithium throughout the reactor core. Excellent dispersal is achieved by forming small cores of a Li compound, having a size on the order of about 300 to 1000 microns, and spacing these from one another, e.g., by means of exterior coatings which totally surround the cores. Distributing the particles 10 throughout the fuel elements of the reactor core further enhances the production of tritium.

The core 12 is formed from a lithium-containing material that is a solid compound of lithium. The compound is selected to be stable at the temperatures employed for the vapor-deposition of the surrounding coatings. Lithium in oxide form, either by itself or in a combination with another refractory-like element, may be employed as the core material. Examples are lithium oxide ($Li_2O$), lithium silicates ($Li_2SiO_3$ and $Li_4SiO_4$), and preferably one of the lithium aluminates $LiAlO_2$ $LiAl_5O_8$. The selected lithium compound has a melting point and other characteristics which render it compatible with the coating processes. It can be employed in any form in which the core has sufficient mechanical stability to render it physically suitable to treatment in a vapor-deposition coater. For example, small cores can be formed by a powder agglomeration process or by cold-pressing in steel dies and then sintered to provide strength and higher density. For example, lithium aluminate powder can be cold-pressed in a die at about 3000 psi and then sintered in a vacuum at about 1200° C. for eight hours. Cores formed by powder agglomeration can also be sintered to provide mechanical strength. If high density is desired, the sintered core can be made spheroidal by being dropped through a hot zone at between 1800° C. and 2200° C. to cause them to melt and densify into spheroidal shapes in accordance with known technology. A preferred method of forming a $LiAlO_2$ core 12 is by the method taught in U.S. Pat. No. 4,405,595, in which lithium ions are infused into $Al(OH)_3$ gel spheroids, and the infused gel spheroids subsequently sintered.

Generally, the cores 12 have a density of at least about 70% of theoretical density. By theoretical density is meant the maximum density for that particular stoichiometric compound. The preferred lithium compound, lithium aluminate, has a theoretical density of about 2.55 grams per $cm^3$. Although densification to a density approaching theoretical density is possible, it may be preferred to employ cores in the range of about 70% to 80% of theoretical density from the standpoint both of spatial dispersion and ultimate accommodation of the gaseous products of the lithium transmutation.

The impervious carbon seal layer 22, which is applied to the core to isolate the core from subsequent coating atmospheres, is applied at about 1300° C. Substantially higher coating temperatures would tend to create intercalation compounds between the lithium and the carbon and result in loss of lithium from the core. The inner seal coating 22 may be deposited in a particulate bed fluidized by gas flow or in a rotating drum or other type of agitated bed coater. The pyrocarbon seal layers should have a density of about 1.8 to 2.0 gram/$cm^3$ and are preferably oriented. A thickness of about 10 to 20 microns of such pyrocarbon provides an adequate seal coating and can be deposited from a mixture of propylene plus an inert gas, such as argon.

The outer zirconium carbide seal layer 20, which prevents lithium migration from the core during the subsequent high temperature deposition of the outer SiC coating 16, has been found to be effective within a limited range of stoichiometric ratios, i.e., having very nearly a 1:1 atom ratio of zirconium to carbon. In particular, the composition of the outer seal layer is $ZrC_x$ where x is between about 0.9 and about 1.0. In practice, the ZrC can be deposited so that there is a very small amount of carbon present as a second phase, ensuring that the composition of the ZrC is 1 Zr:1 C.

The ZrC layer is pyrolytically deposited from a mixture of a hydrocarbon, a zirconium-containing gas, such as a zirconium halide, and an inert gas. The ZrC layer must be applied under conditions that do not allow lithium interaction with carbon seal layer 22 which would allow the lithium to escape from the core. If Li were to penetrate the inner seal layer 22, it would readily react with the hydrogen halide, e.g., HCl, that is produced during ZrC deposition. Depositing ZrC so that Li does not penetrate the pyrocarbon seal 22 requires that the ZrC layer be applied at a relatively low temperature, preferably below about 1300° C. It is found that methane, the hydrocarbon usually employed for ZrC coating, will not form ZrC in the desired stoichiometric amounts at temperatures below 1300° C. Instead, a hydrocarbon that is unstable relative to methane, such as propane, propylene or acetylene is selected as the coating hydrocarbon.

The hydrocarbon and the zirconium halide, preferably $ZrCl_4$, are supplied in appropriate ratios in the inert carrier gas, e.g., argon, to the coating chamber which is maintained at between about 1300° C. and about 1320° C. to deposit the coating. To prevent lithium loss from the core 12 during subsequent SiC coating, the ZrC seal layer 20 is deposited continuously circumferentially about the pyrocarbon-coated core to a thickness of at least about 10 microns. It is not desirable to make the ZrC layer unduely thick as this would add to the volume of the particle without affording any additional benefits, and generally the ZrC seal layer is less than about 30 microns thick.

Although a primary reason for providing the ZrC seal layer 20 is to prevent lithium migration from the core 12 during SiC coating, the ZrC seal layer in most of the particles remains intact during reactor service, retaining lithium and some of the bred tritium and helium within. ZrC has some permeability to both tritium and helium, allowing the bred gases to diffuse through the ZrC layer to the porous buffer layer 14, usually before the gas pressure within the ZrC layer builds to cause cracks to appear in the ZrC layer. ZrC, nevertheless, is significantly retentive of helium and tritium, and in the case of most particles wherein the ZrC remains intact during reactor service, the seal layer 20 serves as a first gas-retentive barrier, preventing escape of tritium from the particle. If the ZrC layer remains intact, and even if some fractures do appear in the ZrC layer, the ZrC layer acts as a barrier, preventing any significant migration of lithium outward during reactor service.

The neutron capture cross section of ZrC is relatively lower than SiC, and therefore, the seal layer does not add significantly to the total shielding of the SiC-coated particle. Unlike several other potential seal layer substances, the activation of ZrC under neutron bombardment is within acceptable limits for subsequent particle processing.

The porous buffer layer 14 that is provided for the accommodation of the helium and tritium within the minute pressure vessels 10 is preferably pyrocarbon having a density between about 0.9 and 1.2 gram/cm$^3$. The thickness of the porous pyrocarbon layer is dependent upon the amount of $^6$Li included within the core and the pressure which the outer three-layer coating is designed to withstand.

If there are no constraints on the amount of space occupied by the target particles in the nuclear reactor core, larger amounts of porous material can be included so as to prevent the build-up of high gas pressures within the gas-tight outer coating 16. On the other hand, if particular constraints limit the amount of space, a lesser thickness of the porous pyrocarbon layer 14 may be employed along with a slightly thicker outer coating, which will withstand the higher gas pressure build-up. In general, for cores made with natural lithium (7.4% $^6$Li) in the 300 to 1000 micron range, the porous pyrocarbon buffer layer 14 is deposited to a thickness of between about 30 and about 100 microns.

The outer coating 16 which provides the diffusion barrier to prevent the escape of tritium is provided by a continuous shell of dense silicon carbide. The reactor may be operated so that the temperature of the target particles may be in the range of about 900° to 1000° C., at which dense silicon carbide provides an effective barrier to the passage of tritium. As in any such barrier material, the thicker the material, the more effective the barrier, and at least about 35 microns of SiC is deposited. A continuous, circumferentially encapsulating silicon carbide layer having a thickness of 90 microns or even greater might be deposited. The carbide barrier layer should have a density of at least 3.18 g/cm$^3$. Deposition of silicon carbide from a vaporous atmosphere can be consistently carried out to achieve densities of this magnitude. For example, for SiC, which has a theoretical density of 3.22 grams/cm$^3$, densities greater than 3.20 grams/cm$^3$ can be achieved.

Preferably, disposed immediately interior and exterior of the SiC coating are layers 30, 32 of isotropic pyrocarbon, having densities between about 1.7 and about 2.0 grams/cm$^3$ and having individual thicknesses of between about 35 and 45 microns. Such isotropic coatings are deposited from a mixture of acetylene, propylene and inert gas at a temperature of about 1350° C. under conditions so that they will have a BAF (Bacon Anisotrophy Factor) of less than about 1.05. The interior pyrocarbon layer 30 serves as a barrier to prevent chlorine (which is present in the coating atmosphere) from reaching the core where undesirable chemical reactions may occur during the process when the silicon carbide is being deposited. The exterior continuous pyrocarbon layer 32 has a larger strain to fracture ratio than the relatively brittle carbide and thus provides mechanical handling strength for the target particles following completion of the coating operation. High mechanical handling strength is required, for example, if the particles are bonded with pitch or the like to form short rods to be loaded into reactor fuel chambers. During operation in the reactor core, the outer isotropic pyrolytic carbon layer undergoes a controlled shrinkage as a result of exposure to high temperature and fast neutrons, and it shrinks radially onto the silicon carbide coating, placing it in compression and increasing the strength of the silicon carbide coating as a minute pressure vessel.

The silicon carbide coating 16 is preferably deposited by the thermal decomposition of methyltrichlorosilane at temperatures between about 1500° C. and about 1550° C. Without the ZrC seal layer, Li would diffuse from the core outward at these temperatures and react with the HCl that results from decomposition of the methyltrichlorosilane in addition to forming intercalation compounds with the carbon coatings. The ZrC layer substantially prevents any diffusion of the Li from the core during SiC deposition. Subsequently, when the particle is disposed within the nuclear reactor core as a neutron target, neutron bombardment and pressure buildup within the core may cause fractures within the ZrC layer, and then the bred tritium (and helium) will be able to escape into the porous buffer layer.

Release of tritium from the particles can be accomplished by thermal or mechanical means, and the preferred release process will depend upon how the particles are disposed as neutron targets within a nuclear reactor. For example, heating the particles to between about 1300° C. to 1400° C. or above effects relatively prompt diffusion of tritium through the SiC coating, which was very effective in restraining passage of tritium at lower temperatures. Alternatively, the tritium may be released by crushing the particles, preferably with heating to at least to about 500° C. to effect quick release of the tritium.

Ultimate recovery of tritium (T) from a gaseous atmosphere is preferably effected by conversion of the tritium to $T_2O$ by oxidation using a suitable oxygen source, such as copper oxide. $T_2O$ has physical characteristics quite similar to ordinary water and is then removed from the gas stream by a molecular sieve or by freezing in a suitable cold trap, such as liquid nitrogen. Alternatively, tritium can be recovered as a hydride, instead of being oxidized, by exposure to zirconium or titanium sponge metal.

The following example illustrates formation of a presently preferred embodiment of a neutron target particle for the production and retention therewithin of tritium; however, it should not be understood to in any way limit the scope of the invention which is defined solely by claims at the end of this specification.

EXAMPLE

Aluminum hydroxide spheroids are formed by a conventional sol-gel method, washed in ammonium hydroxide and then placed in 5N LiOH solution to infuse lithium ions into the spheroids until approximately a 1:1 ratio of Li to Al is achieved in the spheroids. The gel spheroids are rinsed for about 30 seconds in 28% ammonium hydroxide and soaked in isopropyl alcohol. After drying, the spheroids are sintered at 1250° C. for four hours, forming spherical $LiAlO_2$ particles ranging in diameter from about 300 microns to 600 microns and averaging about 450 microns. The spherical particles have a density equal to about 80 percent of theoretical density.

An impervious layer of oriented pyrocarbon about 10 microns thick and having a density of 1.9 grams/cm$^3$ is applied in a fluidized bed coater using a mixture of propylene and argon at a temperature of about 1300° C.

Then in the same coater, at a temperature of about 1300° C., in an atmosphere of propylene, $ZrCl_4$ and hydrogen in a 3:10:700 ratio, a coating of ZrC containing about 0.1% carbon is deposited to a thickness of 15 microns.

Following deposition of the ZrC layer, the temperature is lowered to about 1100° C. Using a mixture of acetylene and helium at about a 9:1 volume ratio, a buffer layer of spongy pyrocarbon having a density of about 1.1 grams/$cm^3$ is deposited to a thickness of about 45 microns.

Following deposition of the porous buffer layer 14, the temperature is raised to about 1350° C., and a mixture of propylene, acetylene and argon is employed to deposit about 35 microns of isotropic pyrocarbon having a density of about 1.9 grams/$cm^3$ and a BAF of about 1.02.

The temperature of the coater is then raised to about 1550° C., and hydrogen is employed as the fluidizing gas. Approximately 10% of the hydrogen stream is bubbled through a bath of methyltrichlorosilane. Under these conditions, silicon carbide having a density of about 3.20 grams/$cm^3$, which is beta-phase SiC, is deposited to create a continuous encapsulating layer about 35 microns thick.

Thereafter, argon is again used as the fluidizing gas, and the temperature is lowered to about 1370° C. A mixture of acetylene, propylene and argon is then employed to deposit about 45 microns of isotropic pyrolytic carbon having a density of about 1.85 grams/$cm^3$ onto the silicon carbide layer. Thereafter, the particles are slowly cooled in a stream of inert gas until they approach room temperature and are removed from the coater.

A sample of target particles 10 prepared according to the present invention is disposed by means of a removable probe into the core of a HTGR nuclear reactor where they are exposed to an estimated thermal neutron flux of $5\times10^{13}$n/(sec. $cm^2$) at temperatures ranging from 700° C. to 1000° C. The particles remain in the nuclear reactor until they encounter a sufficient dosage of thermal neutrons to transmutate at least 95% of the $^6$Li isotopes to helium and tritium. Monitoring of the capsule atmosphere shows that barely measurable amounts of tritium are present during irradiation.

After the particles are removed from the reactor, they are disposed in an autoclave which is supplied with a controlled recirculating helium gas atmosphere. The autoclave is heated to about 1500° C. and held at this temperature for about 10 hours. The circulating helium atmosphere is passed over zirconium sponge material, and the tritium which is released from the target particles in the autoclave is adsorbed on the metal zirconium as zirconium hydride. Following completion of the adsorption, examination of the zirconium sponge shows that tritium has been recovered in an amount equivalent to about 90% of the $^6$Li isotopes present in the target material. Accordingly, such target particles are capable of producing and retaining tritium when exposed to thermal neutrons, which tritium can be released therefrom by heating to about 1500° C. These target particles are considered to be well-suited for use in an HTGR designed for the co-production of tritium and electrical energy.

Although the invention has been described with regard to certain preferred embodiments, which constitute the best mode presently known to the applicants, it should be understood that various changes and modifications as would be obvious to one having the ordinary skill in this art may be made without departing from the scope of the invention which is defined in the claims appended hereto. Various features of the invention are emphasized in the claims which follow.

I claim:

1. A neutron target particle for breeding tritium comprising a central generally spherical core formed of a lithium-containing compound which is stable under coating conditions and conditions within the core of a nuclear reactor, a pyrocarbon seal layer covering said core, a zirconium carbide seal layer covering said pyrocarbon seal layer, a porous pyrocarbon buffer layer surrounding said seal layers, and a silicon carbide coating surrounding said buffer layer.

2. A particle according to claim 1 wherein said core is between about 300 and about 1000 microns in diameter.

3. A particle according to claim 1 wherein said core is formed of a compound selected from the group consisting of $LiAlO_2$ and $LiAl_5O_8$.

4. A particle according to claim 1 wherein said core has a density between about 70 and about 100 percent of theoretical density.

5. A particle according to claim 1 wherein said pyrocarbon seal layer has a density of between about 1.8 and about 2.0 gm/$cm^3$ and a thickness between about 30 and about 40 microns.

6. A neutron target particle for breeding tritium comprising a central generally spherical core formed of a lithium-containing compound which is stable under coating conditions and conditions within the core of a nuclear reactor, a pyrocarbon seal layer covering said core, a zirconium carbide seal layer at least about 10 microns thick covering said pyrocarbon seal layer, said zirconium carbide having the formula $ZrC_x$ where x is between about 0.9 and about 1.0, a porous pyrocarbon buffer layer surrounding said seal layers, and a silicon carbide coating surrounding said buffer layer.

7. A particle according to claim 6 wherein said zirconium carbide layer has a thickness of between about 10 and about 30 microns.

8. A particle according to claim 1 wherein said buffer layer has a density of between about 0.9 and about 1.2 gram/$cm^3$ and a thickness of between about 30 and about 100 microns.

9. A particle according to claim 1 wherein said SiC coating has a density of above about 98% of theoretical density.

10. A particle according to claim 1 having a pyrocarbon layer with a density of between about 1.7 and about 2.0 gm/$cm^3$ and a thickness between about 35 and about 45 microns between said buffer layer and said SiC coating.

11. A particle according to claim 1 having a pyrocarbon layer with a density of between about 1.7 and about 2.0 gm/$cm^3$ and a thickness of between about 35 and about 45 microns around said SiC coating.

12. A method of forming a neutron target particle comprising, forming a generally spherical core from a lithium-containing compound, sealing said core by depositing pyrocarbon on said core at a temperature below about 1300° C. to a thickness of at least about 10 microns, and a density of at least about 1.8 grams/$cm^3$, further sealing said core by pyrolytically depositing on said pyrocarbon seal layer, at a temperature below about 1320° C., zirconium carbide to a thickness of at least about 10 microns, depositing on said zirconium carbide layer a porous pyrocarbon buffer layer having a thickness of between about 30 and about 100 microns and a density of between about 0.9 and about 1.2 gram/$cm^3$, and pyrolytically coating said particle with SiC to a thickness of at least about 35 microns and a density of at least about 98 percent of theoretical density.

13. A mehod according to claim 12 wherein said ZrC layer is deposited by pyrolytic decomposition of a mixture of a zirconium halide and a hydrocarbon selected from the group consisting of acetylene, propane and propylene.

14. A method according to claim 12 wherein depositing said zirconium carbide is carried out using a gas mixture and temperature appropriate to form zirconium carbide having the formula $ZrC_x$ where x is between about 0.9 and about 1.0.

15. A particle according to claim 1 wherein said zirconium carbide layer has a thickness of between about 10 and about 30 microns.

16. A particle according to claim 6 wherein said core is between about 300 and about 1000 microns in diameter.

17. A particle according to claim 6 wherein said core is formed of a compound selected from the group consisting of $LiAlO_2$ and $LiAl_5O_8$.

18. A particle according to claim 6 wherein said core has a density between about 70 and about 100 percent of theoretical density.

19. A particle according to claim 6 wherein said pyrocarbon seal layer has a density of between about 1.8 and about 2.0 gm/$cm^3$ and a thickness between about 30 and about 40 microns.

20. A particle according to claim 6 wherein said SiC coating has a density of above about 98% of theoretical density.

* * * * *